United States Patent [19]

Hohberg et al.

[11] Patent Number: 4,462,576

[45] Date of Patent: Jul. 31, 1984

[54] APPARATUS FOR SUPPLYING GAS THROUGH THE WALL OF A METALLURGICAL CONTAINER

[75] Inventors: Alfried Hohberg, Essen; Udo Muschner, Tönisvorst, both of Fed. Rep. of Germany

[73] Assignee: Didier-Werke AG, Wiesbaden, Fed. Rep. of Germany

[21] Appl. No.: 467,193

[22] Filed: Feb. 16, 1983

[30] Foreign Application Priority Data

Feb. 24, 1982 [DE] Fed. Rep. of Germany ..... 3206499
Dec. 23, 1982 [DE] Fed. Rep. of Germany ..... 324716

[51] Int. Cl.[3] ..... C21C 5/34
[52] U.S. Cl. ..... 266/220; 266/266
[58] Field of Search ..... 266/220, 265, 266; 75/60; 425/446

[56] References Cited

U.S. PATENT DOCUMENTS

| | | | |
|---|---|---|---|
| 3,615,086 | 10/1971 | Jepson et al. | 266/220 |
| 4,340,208 | 7/1982 | Vayssiere et al. | 75/60 |
| 4,378,106 | 3/1983 | Hirschberg et al. | 75/60 |
| 4,395,026 | 7/1983 | Hodl et al. | 266/265 |

*Primary Examiner*—L. Dewayne Rutledge
*Assistant Examiner*—Robert L. McDowell
*Attorney, Agent, or Firm*—Wenderoth, Lind & Ponack

[57] ABSTRACT

An apparatus for supplying gas through the wall of a metallurgical container includes a fireproof refractory brick having a free inner end adapted to be exposed to the interior of the metallurgical container, an outer end opposite the inner end and a peripheral area extending between the outer and inner ends. A metal cover surrounds the peripheral area. A gas connection supplies gas to the outer end of the brick. Gas passages extend from the outer end of the brick to the inner end of the brick to supply gas to the interior of the metallurgical container. These gas passages are in the form of at least one arrangement of a fireproof ceramic fiber material extending between the outer and inner ends of the brick.

23 Claims, 5 Drawing Figures

APPARATUS FOR SUPPLYING GAS THROUGH THE WALL OF A METALLURGICAL CONTAINER

BACKGROUND OF THE INVENTION

The present invention is directed to an apparatus for supplying gas through the wall of a metallurgical container. More specifically, the present invention is directed to such an apparatus usable for supplying a gas to a molten metal within a metallurgical container for treatment of such metal.

In a known such apparatus, a gas permeable fireproof refractory brick is positioned within the wall of the metallurgical container, and gas is caused to pass through such porous brick, and into the molten metal within the container. However, in this known arrangement, the open pores of the brick result in a unique source of premature wear of the brick. Such wear is caused particularly by molten metal entering the pores of the porous brick.

An additional arrangement is known whereby a fireproof refractory brick is covered by a metal cover, for example of sheet metal, and the brick has a very high number of closed pores, whereby the gas substantially cannot be caused to flow through the brick itself. As a result, the gas essentially flows through the area between the metal cover and the brick. A ring-shaped gas discharge cross section thus is formed, and this cross section creates a very uneven gas discharge flow into the molten metal because of the relatively uneven surface conditions of the brick and the metal cover. In other words, the metal cover does not fit evenly around the brick. As a result, at some spots around the brick no gas at all or very little gas is discharged, with the result that the treatment of the molten metal is not satisfactory.

Both of the above known arrangements have the disadvantage of rapid closing up of the cross section of the gas discharge areas, thereby hampering considerable the gas supply operation. Thus, in the first arrangement, the molten metal enters the pores of the porous brick. In the second known arrangement, the molten metal passes into the small dimensioned areas between the metal cover and the brick.

SUMMARY OF THE INVENTION

With the above discussion in mind, it is the object of the present invention to provide an apparatus for supplying a gas through the wall of a metallurgical container, while overcoming the above and other prior art disadvantages.

It is a further object of the present invention to provide such an apparatus which has increased effectiveness and operation and improved durability.

It is a still further object of the present invention to provide such an apparatus whereby it is possible to ensure a uniformity of the cross-sectional configuration of gas supply passages.

These objects are achieved in accordance with the present invention by the provision of an apparatus for supplying gas through the wall of a metallurgical container and including a fireproof refractory brick having a free inner end adapted to be exposed to the interior of a metallurgical container, an outer end opposite the inner end, and a peripheral area extending between the outer and inner ends. The fireproof refractory brick is formed to have only a very slight permeability to the gas being supplied. A metal cover surrounds the peripheral area of the brick. Means is provided for supplying gas to the outer end of the brick. Gas passage means extend from the outer end of the brick to the inner end thereof, and operate to supply gas to the interior of the metallurgical container. The gas supply passage means in accordance with the present invention are in the form of at least one arrangement of a fireproof ceramic fiber material extending between the outer and inner ends of the brick.

Thus, in accordance with the present invention, the gas supply passages are provided by fireproof fiber materials which are compressed in such a manner and which are installed in and/or around the brick in such a manner that a desired gas permeability is guaranteed. However, in accordance with the present invention, detrimental affects of the molten metal are avoided, since the molten metal does not plug up those areas which are employed as gas passages. In other words, the molten metal is prevented from filling up open pores of the structure. The required firmness for the fiber materials is provided by those elements directly surrounding and contacting the fiber material. As a result, the apparatus of the present invention has an unusually high durability and effectness.

In accordance with the present invention, the fiber material may be in at least one configuration selected from the group consisting of a mat form of fiber material, a sheet form of fiber material, a band form of fiber material, a rope form of fiber material and a string form of fiber material.

The fiber material is held in place and/or compressed between separate sections of the brick and/or between the brick and the metal cover. The compression of the fiber materials achieves a desired gas permeability of the particular gas passages formed. The fiber material can be in the configuration of preformed profiles which are positioned within counter-profiled portions of the brick and/or of the metal cover. Also, the fiber material may be in the form of a preconfigured profile which is molded into the brick and/or between the brick and the metal cover, whereby the metal cover serves as a mold into which the brick material is poured after the preferably precompressed profiled fiber material has been inserted.

In accordance with a further feature of the present invention, there are provided spacer means for maintaining constant the thickness of the fiber material, and thereby for maintaining constant the transverse cross-sectional dimensions of the gas passages. Such spacer means may be provided between sections of the brick and/or between the brick and the metal cover. Such spacer means may be in the form of metal strips and/or stamped-out portions of the metal cover, and may be formed on the metal covers.

BRIEF DESCRIPTION OF THE DRAWINGS

The above and other objects, features and advantages of the present invention will be apparent from the following detailed description of preferred embodiments thereof, with reference to the accompanying drawings, wherein.

DETAILED DESCRIPTION OF THE INVENTION

Figure 1:
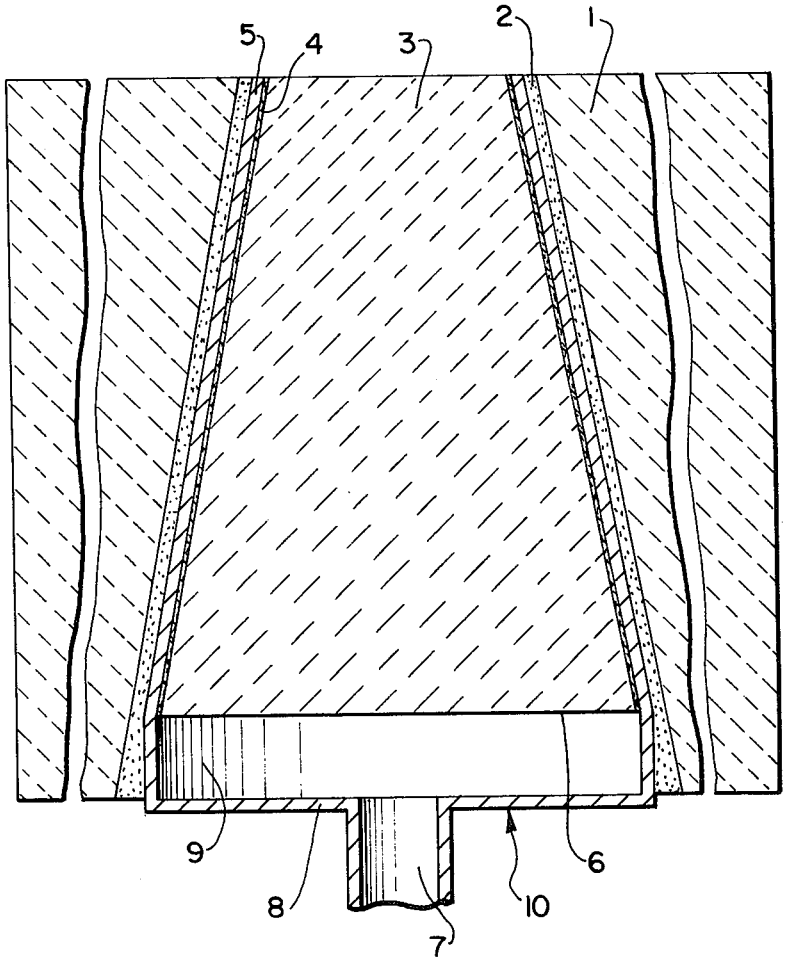
FIG. 1 is a longitudinal cross section of an apparatus in accordance with the present invention having a truncated cone-shaped configuration.

In FIG. 1, there is illustrated a perforated fireproof refractory brick 1 which is positioned within the fireproof ceramic lining of a metallurgical container, not shown, and into the interior of which a gas is to be supplied. A gas supply apparatus, generally indicated by 10, is mounted removably within perforated brick 1 to be installed and removed from the exterior and to be retained in perforated brick 1 by refractory mortar 2. Apparatus 10 includes a truncated cone-shaped fireproof ceramic brick 3 which has an inner end, i.e. the upper end in FIG. 1, adapted to be free and to be exposed to the interior of the metallurgical container. Brick 3 has an outer end 6, and a peripheral area extending between the outer and inner ends. The peripheral or side area of brick 3 is covered with a mat of fireproof ceramic fiber material 4 which in turn is surrounded by a metal cover 5, for example formed of a suitable sheet metal material. The outer end of metal cover 5 projects beyond the outer end 6 of brick 3 and is closed by an integral metal bottom 8 which is spaced from the outer end 6 of the brick 3 to define therebetween a gas collecting area 9. A gas supply pipe connection 7 opens through metal bottom 8 into collecting area 9.

Depending on the predetermination of the permeability of brick 3, the gas flows more or less intensively through the apparatus 10 along a gas passage formed by the layer of fiber material 4. For a brick 3 with a very slight permeability, the gas flows primarily entirely through the layer of fiber material 4 between the metal cover 5 and the brick 3. As a result, the gas enters the molten metal within the metallurgical container in an even manner because of the constant cross section of the layer of fiber material 4. Furthermore, this gas passage or channel is maintained open due to the compressed fiber material therein and the comparatively regular pore structure of such fiber material. This makes is possible to limit to a minimum the amount of gas to be fed into the molten metal both during as well as after a particular gas treatment operation, with optimum utilization of the metallurgical container and without the fear of damage to the apparatus by the molten material.

In the arrangement of FIG. 1, the layer of fiber material 4 is compressed between the metal cover 5 and the outer peripheral surface of the brick 3.

Figure 2:
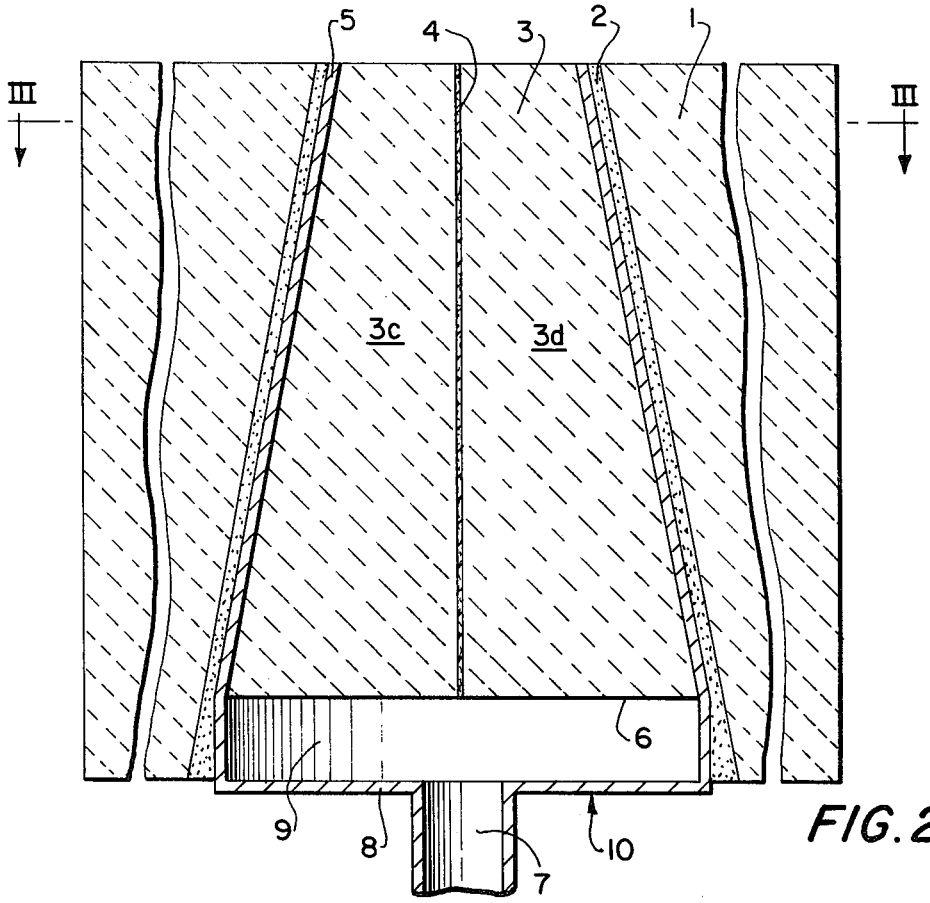
FIG. 2 is a view similar to FIG. 1 but of a modified arrangement wherein the brick is divided longitudinally into sections.
Figure 3:
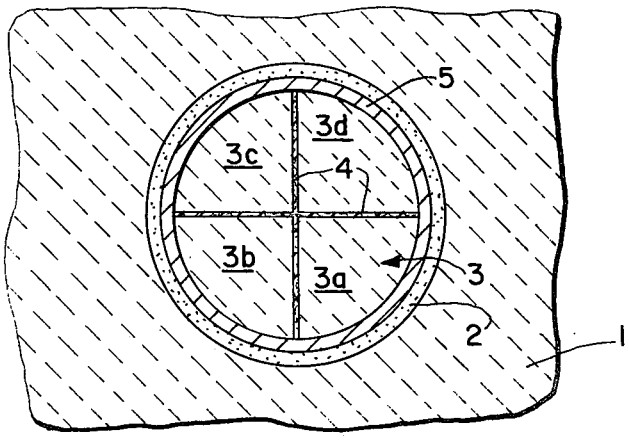
FIG. 3 is a transverse cross section taken along line III—III of FIG. 2.

The embodiment of FIGS. 2 and 3 is similar to the embodiment of FIG. 1, with the exception that the brick 3 shown in FIGS. 2 and 3 is divided into plural sections, i.e. four sections 3*a*, 3*b*, 3*c*, 3*d*, which sections extend between the outer and inner ends of the brick. Furthermore, in this embodiment of the present invention, the fiber material 4 is positioned between the divided sections. Thus, the configuration of the gas discharge area is cross-shaped, as opposed to ring-shaped as in the embodiment of FIG. 1. The fiber material 4 may be in mat form and may be compressed to a desired gas permeability between the adjacent sections of the brick and by means of the metal cover 5 pressing on the outer peripheral surfaces of the sections of the brick.

Figure 4:
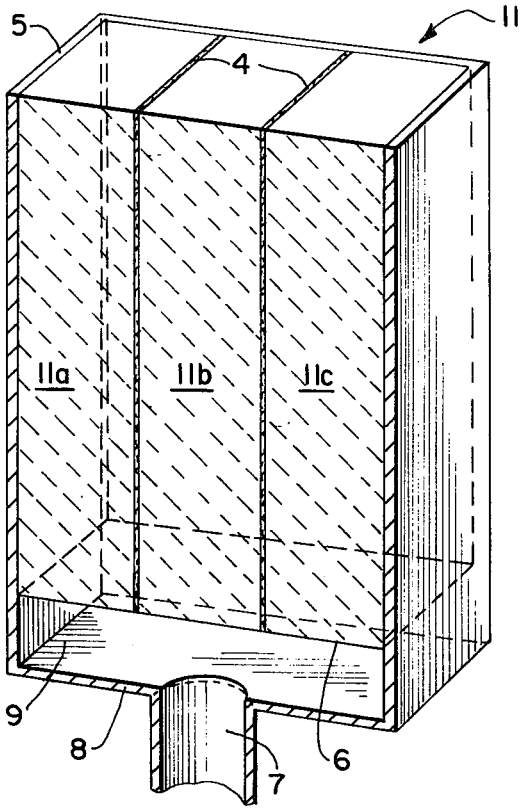
FIG. 4 is a perspective view of a further embodiment of the present invention.

The concept of the present invention is not intended to be limited to the truncated cone-shaped configurations illustrated in FIGS. 1–3, since the apparatus of the present invention may have a multitude of molded shapes. One such molded shape is illustrated in FIG. 4, wherein the brick 11 therein is shown to have a generally rectangular configuration. Furthermore, in this embodiment, the brick 11 is divided longitudinally into plural sections, i.e. three sections 11*a*, 11*b*, 11*c*, which extend between the outer and inner ends of the brick. Layers of fiber material 4 are positioned between adjacent sections of the brick. The layers of fiber material are compressed to a desired degree of gas permeability between the brick sections and by means of the metal cover 5.

It of course is to be understood that the various features illustrated in each of the above described and illustrated embodiments may be employed interchangably. Thus, the embodiments of FIGS. 2–4 also could be provided with layers of mat material arranged between the peripheral brick surfaces and the inner surface of the respective metal cover.

Additionally, it is intended to be within the scope of the present invention to have grooves, splines or other such configural arrangements on the outside of the brick and into which are inserted other configured arrangements of the fiber material, such as strings, bands, ropes of fiber material, which then are compressed by a counter-profile on the metal cover. Furthermore, the arrangement could be the reverse, i.e. to have the grooves or splines on the metal cover and the counter-profiles on the brick. It is possible further to provide that the arrangements of fiber material may be preformed profiles molded into the brick.

In accordance with the above described embodiments of the present invention, there exists the possibility that the gas passages formed by the particular arrangements of fiber material may be unduly or unevenly compressed due to operating conditions, for example due to thermal stress. Such disadvantage may be overcome in accordance with a further feature of the present invention illustrated in FIG. 5. Thus, in accordance with this embodiment of the present invention, there are provided range spacers or spacer elements for maintaining constant the transverse cross-sectional area of the fiber material. This makes it possible to ensure the provision of an even discharge of gas.

Figure 5:
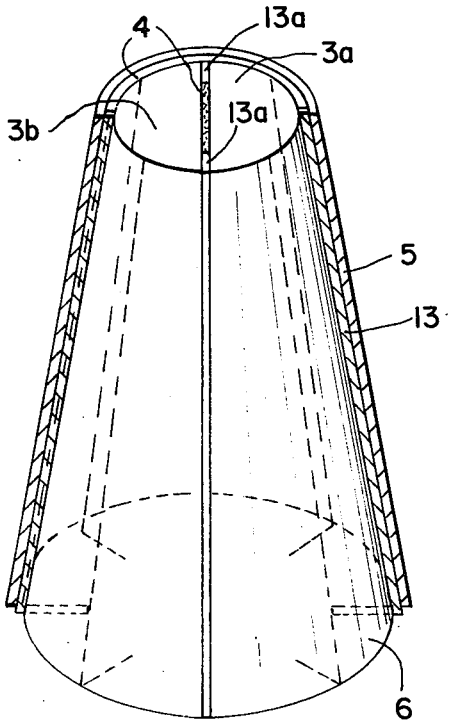
FIG. 5 is a perspective view, partially in cross section, illustrating in a schematic manner spacers which may be incorporated into any of the embodiments of the present invention.

The spacers may be provided between the metal cover 5 and the exterior of the brick, as illustrated schematically by spacers 13 in FIG. 5. Such spacers are installed to extend along the direction of flow of the gas in the gas passage or passages defined by the layers of fiber material. Plural spacers are distributed evenly around the periphery of brick 3 and have outer ends bent over the outer end 6 of brick 3. Various of the thus spaced spacers 13 are shown schematically by dashed lines in FIG. 5.

Furthermore, in the event that the brick 3 is divided into plural sections, such as sections 3*a*, 3*b* shown in FIG. 5, and wherein fiber material 4 is positioned between such brick sections, other spacers 13*a* may be provided between and in abutment with such brick sections. It is possible for an arrangement to include both or either of the spacers 13, 13*a* illustrated in FIG. 5.

The spacers may be in the form of metal strips, such as from a sheet metal material. Alternatively, the spacers 13 may be in the form of stamped-out portions of the metal cover 5. Also, although the spacers 13, 13*a* illustrated in FIG. 1 extend throughout the entire longitudinal length of the respective gas flow passages, spacers may be provided only over a portion of such longitudinal dimension, for example such as being located adjacent the inner end and the outer end 6 of the brick.

It is to be understood that the concept of the present invention is not limited to the use of any specific compositions for the various elements and features of the present invention. Thus, it is intended that the various bricks, metal covers, and fiber material arrangements may be formed of any material known in the art, as would be understood by those skilled in the art. Furthermore, it is not intended that the present invention be limited to any particular thickness of the layer or layers of fiber material 4. It has however been determined to be particularly advantageous that the layers of fiber material 4 be compressed to define gas passage thicknesses of from 0.4 to 1.2 mm.

Although the present invention has been described and illustrated with regard to specifically embodiments thereof, it is to be understood that various modifications may be made to the specifically described and illustrated features without departing from the scope of the present invention.

We claim:

1. An apparatus for supplying gas through the wall of a metallurgical container, said apparatus comprising:

a fireproof refractory brick having a free inner end adapted to be exposed to the interior of a metallurgical container, an outer end opposite said inner end, and a peripheral area extending between said outer and inner ends;

a metal cover surrounding said peripheral area;

means for supplying gas to said outer end of said brick; and gas passage means, extending from said outer end of said brick to said inner end thereof, for supplying said gas to the interior of the metallurgical container, said gas passage means comprising at least one gas passage completely filled with fireproof ceramic fiber material extending between said outer and inner ends of said brick.

2. An apparatus as claimed in claim 1, wherein said fiber material is in at least one configuration selected from the group consisting of mat form, sheet form, band form, rope form and string form.

3. An apparatus as claimed in claim 1, wherein said brick is in divided sections extending between said outer and inner ends, and said fiber material is positioned between said divided sections.

4. An apparatus as claimed in claim 3, further comprising spacer means for maintaining constant the thickness of said fiber material between said divided sections.

5. An apparatus as claimed in claim 4, wherein said spacer means comprise metal strips positioned between and spacing said divided sections.

6. An apparatus as claimed in claim 3, further comprising fiber material positioned between said metal cover and said peripheral area of said brick.

7. An apparatus as claimed in claim 6, further comprising spacer means for maintaining constant the thickness of said fiber material between said metal cover and said peripheral area of said brick.

8. An apparatus as claimed in claim 7, wherein said spacer means comprise metal strips positioned between and spacing said metal cover and said peripheral area of said brick.

9. An apparatus as claimed in claim 7, wherein said spacer means comprise stamped-out portions of said metal cover.

10. An apparatus as claimed in claim 1, wherein said fiber material is positioned between said metal cover and said peripheral area of said brick.

11. An apparatus as claimed in claim 10, further comprising spacer means for maintaining constant the thickness of said fiber material between said metal cover and said peripheral area of said brick.

12. An apparatus as claimed in claim 11, wherein said spacer means comprise metal strips positioned between and spacing said metal cover and said peripheral area of said brick.

13. An apparatus as claimed in claim 11, wherein said spacer means comprise stamped-out portions of said metal cover.

14. An apparatus as claimed in claim 1, wherein said fiber material is positioned within counter-profiled portions of said brick and/or said brick and said metal cover.

15. An apparatus as claimed in claim 1, wherein said fiber material is molded into said brick.

16. An apparatus as claimed in claim 15, wherein said fiber material is precompressed.

17. An apparatus as claimed in claim 1, wherein said fiber material is compressed to define a gas passage thickness of from 0.4 to 1.2 mm.

18. An apparatus as claimed in claim 1, wherein said metal cover extends outwardly beyond said outer end of said brick and is closed by an integral metal bottom which is spaced from said outer end of said brick to define therebetween a collecting area, and said gas supplying means includes a gas supply pipe connection opening through said metal bottom into said collecting area.

19. An apparatus as claimed in claim 1, wherein said brick is in the form of a truncated cone with said inner end being smaller than said outer end.

20. An apparatus as claimed in claim 19, wherein said fiber material is compressed between said metal cover and said peripheral area of said brick.

21. An apparatus as claimed in claim 19, wherein said brick is divided into sections extending between said outer and inner ends, and said fiber material is compressed between said sections.

22. An apparatus as claimed in claim 1, wherein said brick has a rectangular configuration and is divided into sections extending between said outer and inner ends, and said fiber material is compressed between said sections.

23. An apparatus as claimed in claim 1, further comprising spacer means for maintaining constant the transverse cross-sectional area of said fiber material.

* * * * *